US005749098A

United States Patent [19]

Evans

[11] Patent Number: 5,749,098

[45] Date of Patent: May 12, 1998

[54] FOLDABLE GARMENT ATTACHMENT ASSEMBLY

[76] Inventor: Gretta S. Evans, 8244 Montgomery Ridge Rd., Belews Creek, N.C. 27009

[21] Appl. No.: 569,734

[22] Filed: Dec. 8, 1995

[51] Int. Cl.[6] ..... A41D 19/00; A41B 7/00

[52] U.S. Cl. ..... 2/123; 2/60; 2/59; 2/124; 2/160; 2/917

[58] Field of Search ..... 2/69, 70, 79, 80, 2/108, 126, 139, 159, 158, 160, 227, 269, 919, 920, 917, 59, 60, 123, 124

[56] References Cited

U.S. PATENT DOCUMENTS

| | | | |
|---|---|---|---|
| 2,187,447 | 1/1940 | Chait et al. | 2/269 |
| 3,419,908 | 1/1969 | Germani | 2/123 |
| 3,533,108 | 10/1970 | Feldser | 2/269 |
| 4,149,275 | 4/1979 | Sanchez | 2/269 |
| 4,766,613 | 8/1988 | Wells | 2/269 |
| 5,182,812 | 2/1993 | Goldsby | 2/69 |
| 5,535,453 | 7/1996 | Howard | 2/269 |

*Primary Examiner*—Jeanette E. Chapman

[57] ABSTRACT

A fastener assembly for tubular garments utilizes hook and loop fasteners for quick, secure releasable engagement. Pairs of hook and loop fasteners are positioned around the cuff section of a sleeve and a glove to provide a mating relation to prevent cold air, snow or other adverse elements from entering the wearer's sleeve. The pairs of fasteners are also useful in folding the cuff sections to protect the fasteners when the garments are separated.

18 Claims, 3 Drawing Sheets

FOLDABLE GARMENT ATTACHMENT ASSEMBLY

BACKGROUND OF THE INVENTION

Field of the Invention

An assembly is provided for affixing different articles of clothing such as releasably attaching a glove to a sleeve to increase warmth and comfort as may be desired for skiers, hunters and others that are out of doors during harsh weather conditions. The assembly allows convenient engagement between different garments and also permits the fasteners utilized to be to be shielded from abuse when the garments are separated.

Description of the Prior Art and Objectives of the Invention

With the increase in popularity of winter sports, clothing manufacturers have attempted to provide products which are both warm and comfortable. The wearer's hands and feet are generally the first parts of the body to feel the effects of cold wind, snow and ice. Oftentimes hunters and skiers must terminate their outdoor activities as their hands and feet are adversely affected by the cold conditions.

The attachment of gloves to jacket sleeves is not new, as set forth in U.S. Pat. No. 3,889,297 which shows a glove and sleeve attachment utilizing Velcro. Another sleeve-glove attachment is seen in U.S. Pat. No. 5,073,988. While the prior art demonstrates methods of affixing two garments for various purposes it does not show garments which can be folded upon themselves when said garments are separated to protect the fasteners, nor does it show pairs of fasteners axially aligned and radially spaced.

Thus, with the disadvantages of prior art attachment assemblies, the present invention was conceived and one of its objectives is to present an attachment assembly which can be easily and conveniently utilized by skiers, hunters, and others that are out of doors in cold, adverse weather conditions.

It is another objective of the present invention to provide a releasable garment attachment assembly which can be used on tubular garmet sections such as sleeve, legs, gloves, socks, boots or other wearing apparel.

It is another objective of the present intention to provide a tubular garment having hook and loop fastener positioned interiorly of one garment, and exteriorly of a second garment, to allow secure engagement therebetween.

It is also an objective of the invention to provide opposite fastener pairs on garments, whereby axially folding the garment will allow the opposing pairs to engage and thus maintain the garment in its folded posture to shield the fasteners.

Various other objectives and advantages of the current invention will become apparent as a more detailed description is set forth below.

SUMMARY OF THE INVENTION

A garment attachment assembly is provided for affixing different garments in a easy and convenient method. For example, a glove can be releasably attached to a sleeve to prevent cold air, snow, or other adverse elements from entering the wearer's sleeve and providing discomfort. The attachment assembly can be manually manipulated even if the wearer is gloved or if the fingers and hands are cold and thus less dexterous. Pairs of fasteners are positioned side by side in axial alignment around a tubular garment opening such as around a sleeve, leg or glove cuff. The cuff can be folded to allow opposing, side-by-side fasteners to engage, thus preventing abuse or impact to the fasteners (which may be positioned on the exterior of the cuff section) during usual wear.

Attachment can be provided between a glove and a sleeve by utilizing the fasteners on, for example, the exterior of the glove cuff section and mating fasteners on the interior of the sleeve cuff section, by bringing the glove cuff into the sleeve. The opposing fasteners will engage and secure the glove and sleeve together to prevent air entry and discomfort to the wearer. Other combinations of fastener placement can be utilized depending on the particular circumstances and requirements of the wearer.

DETAILED DESCRIPTION OF THE PREFERRED EMBODIMENT AND OPERATION OF THE INVENTION

Figure 1:
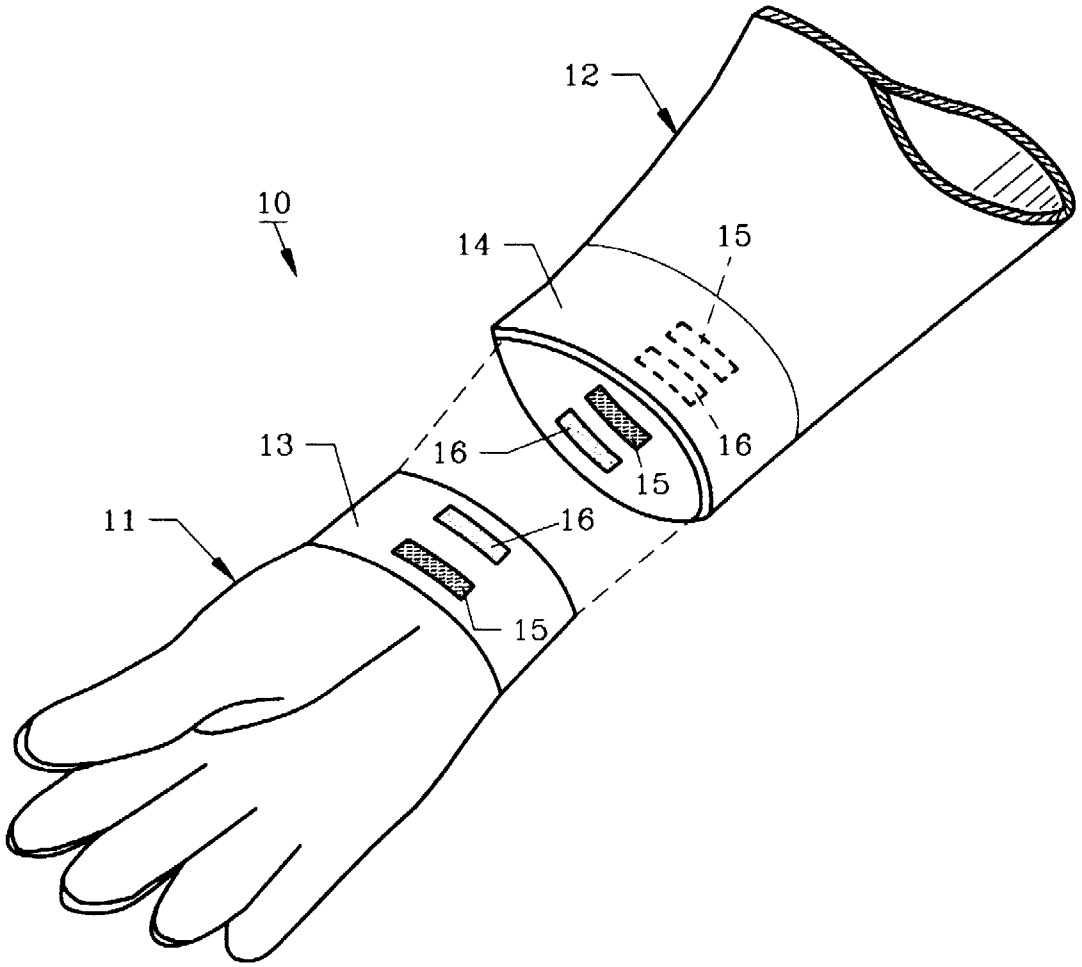
FIG. 1 illustrates the preferred form of the invention with the glove and sleeve cuff sections unfolded and the garments separated.

For a better understanding of the invention and its use, turning now to the drawings, FIG. 1, the preferred form, illustrates a typical garment assembly 10 consisting of a glove 11 and a sleeve section 12 as can be attached for warmth and comfort during wearing. Such assembly may be, for example, a glove and jacket sleeve as used by skiers, hunters or the like in winter weather. Glove 11 includes a tubular cuff section 13 which will telescopically engage tubular cuff section 14 of sleeve 12 as cuff section 14 has a diameter to allow glove cuff section 13 to enter sleeve cuff section 14. In the preferred embodiment, cuff section 14 provides a major garment section, while cuff section 13 provides a minor garment section. Means are provided to secure the engagement of cuff section 13 within sleeve cuff section 14 consisting of a plurality of pairs of hook fasteners 15 and loop fasteners 16 thereon. In FIG. 1, the preferred attachment assembly, pairs of hooks and loop fasteners are arranged in side-by-side alignment radially thereon. As further seen in FIG. 1, when glove 11 is in engagement with sleeve 12, hook fastener 15 along the exterior of cuff section 13 will engage sleeve loop fastener 16 positioned interiorly of sleeve cuff section 14. Likewise, loop fastener 16 positioned along the exterior of glove cuff section 13 will engage hook fastener 15 positioned interiorly of sleeve cuff section 14.

In FIG. 1, two pairs of hook and loop fasteners are shown interiorly of cuff section 14 although more or less pairs of different lengths and widths could be utilized if desired. Cuff section 13 is shown in FIG. 1 with hook fastener 15 and loop fastener 16 shown exteriorly of cuff section 13 and as understood, a second pair of hook and loop fasteners are affixed to the outer top surface of glove cuff section 13 (not shown in FIG. 1). Additional pairs of hook and loop fasteners could be positioned on both cuff section 13 and sleeve cuff section 14 to cooperatively engage if desired, depending on the particular use conditions.

Figure 2:
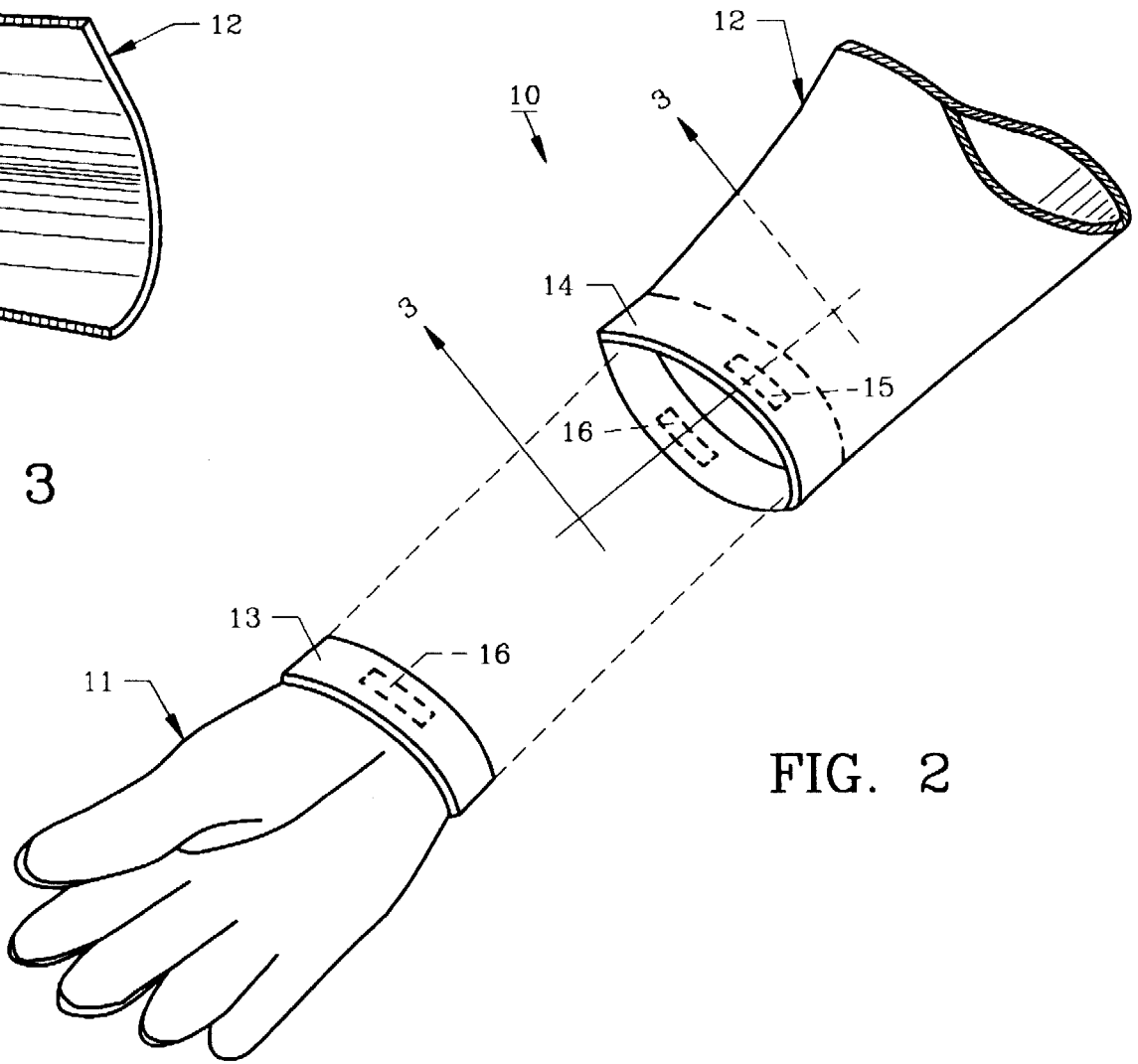
FIG. 2 demonstrates the glove and sleeve as seen in FIG. 1 but with the respective cuff sections folded.
Figure 3:
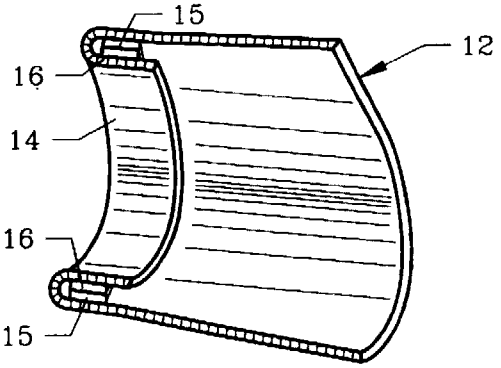
FIG. 3 provides a sectional view of the sleeve cuff along lines 3—3 of FIG. 2 to better illustrate the fastener engagement.

Garment assembly 10 is also seen in FIG. 2 with glove 11 separated from sleeve section 12 as seen in FIG. 1 but with glove cuff section 13 folded upwardly upon itself with loop fastener 16 engaged with hook fastener 15 (not seen). Likewise, cuff section 14 of sleeve 12 is folded downwardly, internally upon itself with hook fastener 15 engaged with loop fastener 16 interiorly of cuff section 14. By so folding cuff section 13 of glove 11 and cuff section 14 of sleeve 12, garments 11, 12 remain unattached and fasteners 15, 16 protected from wear or abuse. In FIG. 3, a sectional view of sleeve 12 is shown to illustrate the engagement of loop fasteners 16 with hook fasteners 15 along lines 3—3 of FIG. 2.

Figure 4:
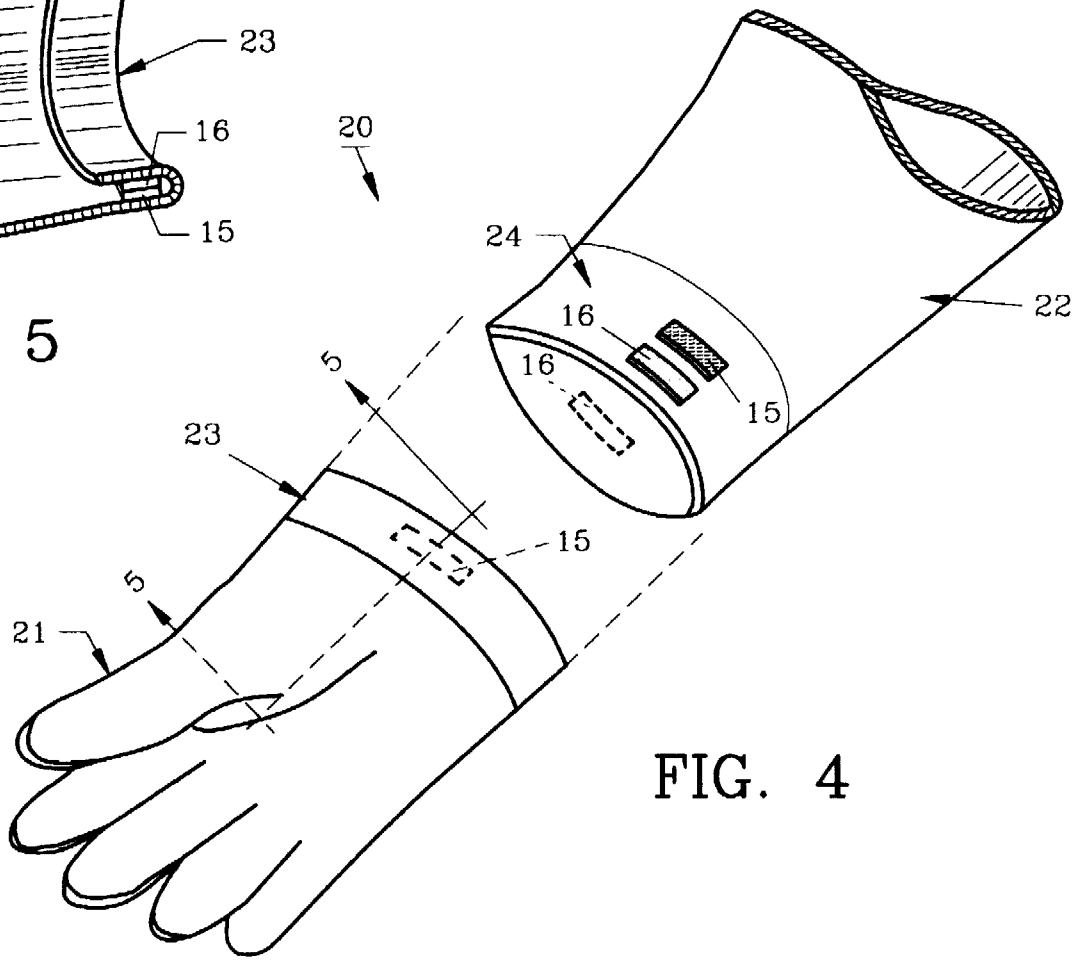
FIG. 4 shows another embodiment of the invention with the sleeve and glove separated and the glove cuff section folded.

In FIG. 4 an alternate embodiment of the invention is shown by assembly 20 whereby glove 21 is illustrated with cuff section 23 folded inwardly, upon itself. As shown, the inner diameter of glove cuff section 23 is greater than the outer diameter of sleeve cuff section 24 whereby sleeve 22 will fit within glove 21 in this alternative embodiment. In this alternative embodiment, glove cuff section 23 provides a major garment section, while sleeve cuff section 24 provides a minor garment section. Sleeve cuff section 24 will fold inwardly upon itself to allow hook fastener 15 to engage with loop fastener 16 of sleeve cuff section 24 when unattached from glove 21. As depicted, loop fasteners 16 and hook fasteners 15 are positioned in pairs, radially along cuff 24 exteriorly thereof whereas hook fasteners 15 and loop fasteners 16 on cuff section 23 of glove 21 are positioned interiorly thereof.

Figure 5:
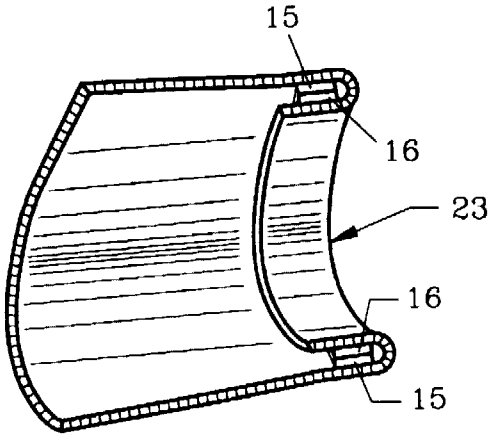
FIG. 5 depicts a sectional view of the glove cuff section folded as seen along lines 5—5 of FIG. 4.

FIG. 5 demonstrates a sectional view of glove 21 along line 5—5 of FIG. 4 as shown with cuff 23 folded inwardly with loop fasteners 16 engaged with hook fasteners 15.

Various changes and modifications can be conceived by those skilled in the art, such as with the use of other fasteners such as adhesives, snaps, buttons, zippers or the like, and the examples provided herein are merely illustrations and are not intended to limit the scope of the appended claims.

I claim:

1. A foldable garment attachment assembly comprising:

(a) a major garment section, a first means for attaching said major garment section, said major garment first attaching means positioned on said major garment section interiorly thereof, a second means for attaching said major garment section, said major garment second attaching means positioned on said major garment section interiorly thereof in spatial axial relation to said major garment first attaching means, said major garment first attaching means selectively engageable with said major garment second attaching means whereby said major garment section can be folded axially with said major garment first attaching means engaging said major garment second attaching means; and (b) a minor garment section, a first means for attaching said minor garment section, said minor garment first attaching means positioned on said minor garment section exteriorly thereof, a second means for attaching said minor garment section, said minor garment second attaching means positioned on said minor garment section exteriorly thereof in spatial axial relation from said minor garment first attaching means, said major garment section sized to receive said minor garment section, said first and said second major garment attaching means being engageable with said first and said second minor garment attaching means, whereby said major garment section is selectively attachable to said minor garment section.

2. The garment attachment assembly of claim 1 wherein said first means for attaching said major garment section comprises a hook fastener.

3. The garment attachment assembly of claim 1 wherein said second means for attaching said major garment section comprises a loop fastener.

4. The garment attachment assembly of claim 1 wherein said first means for attaching said minor garment section comprises a hook fastener.

5. The garment attachment assembly of claim 1 wherein said second means for attaching said minor garment section comprises a loop fastener.

6. The garment attachment assembly of claim 1 wherein said major garment section comprises a sleeve section.

7. The garment attachment assembly of claim 1 whereby said minor garment section comprises a glove section.

8. A foldable garment attachment assembly comprising:

(a) a major garment section, a first means for attaching said major garment section, said major garment first attaching means positioned on said major garment section interiorly thereof, a second means for attaching said major garment section, said major garment second attaching means positioned on said major garment section interiorly thereof and in spatial axial relation to said major garment first attaching means, said major garment first attaching means selectively engageable with said major garment second attaching means whereby said major garment section can be folded axially to allow said major garment first attaching means to engage said major garment second attaching means; and (b) a minor garment section, a first means for attaching said minor garment section, said minor garment first attaching means positioned on said minor garment section exteriorly thereof, a second means for attaching said minor garment section, said minor garment second attaching means positioned on said minor garment section exteriorly thereof in spatial axial relation from said minor garment first attaching means, said major garment section sized to receive said minor garment section, said major garment first and second attaching means engageable with said minor garment first and second attaching means, whereby said major garment section is selectively attachable to said minor garment section.

9. The garment attachment assembly of claim 8 wherein said major garment first attaching means comprises a hook fastener.

10. The garment attachment assembly of claim 8 wherein said major garment second attaching means comprises a loop fastener.

11. The garment attachment assembly of claim 8 wherein said major garment section comprises a sleeve section.

12. The garment attachment assembly of claim 8 wherein said major garment section is interiorly foldable.

13. The garment attachment assembly of claim 8 wherein said minor garment section comprises a glove section.

14. A foldable garment attachment assembly comprising:

(a) A major garment section, a means for attaching said major garment section, said major garment section attaching means positioned on said major garment section interiorly thereof, said major garment section attaching means comprising a hook fastener and a loop fastener, said major garment hook fastener being spaced axially from said major garment loop fastener, said major garment section being axially foldable so that said major garment section attaching means hook fastener and loop fastener are selectively engageable;

(b) a minor garment section, a means for attaching said minor garment section, said minor garment attaching means positioned on said minor garment section exteriorly thereof, said minor garment section attaching means comprising a hook fastener and a loop fastener, said minor garment section hook fastener being spaced axially from said minor garment loop fastener;

said major garment section sized to receive said minor garment section with said major garment and said minor garment attaching means in engageable relation;

whereby said minor garment section can be positioned within said major garment section and be maintained therein by engagement of said major garment attaching means with said minor garment attaching means.

15. The garment attachment assembly of claim 14 wherein said major garment section is interiorly foldable.

16. The garment attachment assembly of claim 14 wherein said major garment section is exteriorly foldable.

17. The garment attachment assembly of claim 14 wherein said major garment section comprises a sleeve section.

18. The garment attachment assembly of claim 14 wherein said minor garment section comprises a glove section.

* * * * *